US005899594A

United States Patent [19]

Piccinino, Jr.

[11] Patent Number: 5,899,594

[45] Date of Patent: May 4, 1999

[54] PROCESSING APPARATUS AND METHOD UTILIZING A TRAY ASSEMBLY AND A GUIDE PATH ARRANGEMENT

[75] Inventor: Ralph L. Piccinino, Jr., Rush, N.Y.

[73] Assignee: Eastman Kodak Company, Rochester, N.Y.

[21] Appl. No.: 08/947,817

[22] Filed: Oct. 9, 1997

[51] Int. Cl.[6] ..... G03D 3/02; G03D 3/08; G03D 13/04

[52] U.S. Cl. ..... 396/612; 396/626; 396/636

[58] Field of Search ..... 396/612, 620, 396/626, 636

[56] References Cited

U.S. PATENT DOCUMENTS

| | | | |
|---|---|---|---|
| 4,710,009 | 12/1987 | Schneider | 396/626 |
| 4,954,838 | 9/1990 | Nakamura et al. | 396/620 |
| 5,168,296 | 12/1992 | Nakamura et al. | 396/620 |
| 5,309,191 | 5/1994 | Bartell et al. | 396/626 |
| 5,311,235 | 5/1994 | Piccinino, Jr. et al. | 396/626 |
| 5,537,179 | 7/1996 | Wernicke et al. | 396/614 |

FOREIGN PATENT DOCUMENTS 0 762 205 A1 6/1996 European Pat. Off. .

*Primary Examiner*—D. Rutledge
*Attorney, Agent, or Firm*—David A. Novais; Frank Pincelli

[57] ABSTRACT

A processing assembly includes a processing tank that has a processing path for photosensitive material. The processing tank includes at least one first processing assembly along a downward portion of the processing path and at least one second processing assembly along an upward portion of the processing path. The processing assemblies include a tray assembly and a guide path or slot which extends from the tray assembly. The guide path or slot receives over flow processing solution from the tray assembly and also guides the photosensitive material.

14 Claims, 4 Drawing Sheets

PROCESSING APPARATUS AND METHOD UTILIZING A TRAY ASSEMBLY AND A GUIDE PATH ARRANGEMENT

FIELD OF THE INVENTION

The present invention relates to a photosensitive material processing apparatus which processes photosensitive material.

BACKGROUND OF THE INVENTION

The processing of photographic material such as film or paper involves a series of steps such as developing, bleaching, fixing, washing and drying. These steps involve the conveyance of a continuous web of film or cut sheets of film or photographic paper sequentially through a series of stations or tanks with each one containing a different processing solution appropriate to the processing step at that station.

The processing tanks of some processing assemblies utilize a series of tray arrangements which process photosensitive material by an overflow of solution. For example, in European Patent application 0762205, conveying rollers are provided above solution pans. Solution is supplied from above the conveying rollers and overflows the solution pans as photosensitive material is transported between the conveying rollers and solution pans. The overflow solution is dropped onto the next lower set of conveying rollers and/or solution pans. In this type of arrangement, as the photosensitive material is transported from the first set of rollers and solution pans to the next lower set of rollers and solution pans, both the solution and photosensitive material are exposed to air. This adversely effects the quality of the photosensitive material as it is transported through the washing apparatus. Additionally, solution exposed to air may crystallize on the rollers which also may cause damage to the photosensitive material.

SUMMARY OF THE INVENTION

The present invention provides for a processing tank and a processing assembly for processing photosensitive materials, which includes a solution tray or pan arrangement that has a guide path or slot extending therefrom. The guide path receives overflow processing solution that is applied to the tray arrangement so as to guide the processing solution, as well as the photosensitive material therethrough.

With the arrangement of the present invention, as the photosensitive material enters the guide path through which the overflow processing solution passes, the photosensitive material can easily interact with the processing solution in the guide path without being exposed to air.

The present invention provides for an apparatus for processing photosensitive material with the apparatus comprising at least one processing tank having a processing path for the photosensitive material. The at least one processing tank comprises at least one first processing assembly along a downward portion of the processing path and at least one second processing assembly along an upward portion of the processing path. Each of the first and second processing assemblies comprise a tray assembly which receive a processing solution therein; a conveying roller assembly at least partially submerged in the processing solution contained in the tray assembly; and a guide path extending from the tray assembly. The guide path receives an overflow of processing solution from the tray assembly and guides the photosensitive material and overflow processing solution therethrough.

The present invention also relates to an apparatus for processing photosensitive material. The apparatus comprises at least one processing tank which includes at least one processing assembly. The at least one processing assembly comprises a receiving portion for receiving processing solution therein and a guiding portion which guides a photosensitive material and overflow processing solution from the receiving portion therethrough.

The present invention also relates to a method of processing photosensitive material which comprises the steps of providing at least one processing assembly in a processing tank, the at least one processing assembly comprising a tray assembly and a guide path extending from the tray assembly; supplying a processing solution to the at least one processing assembly so as to overflow the tray assembly and be lead into the guide path; and conveying a photosensitive material through the guide path of the processing assembly, such that the overflowing processing solution treats the photosensitive material in the guide path

DETAILED DESCRIPTION OF THE INVENTION

Figure 1:
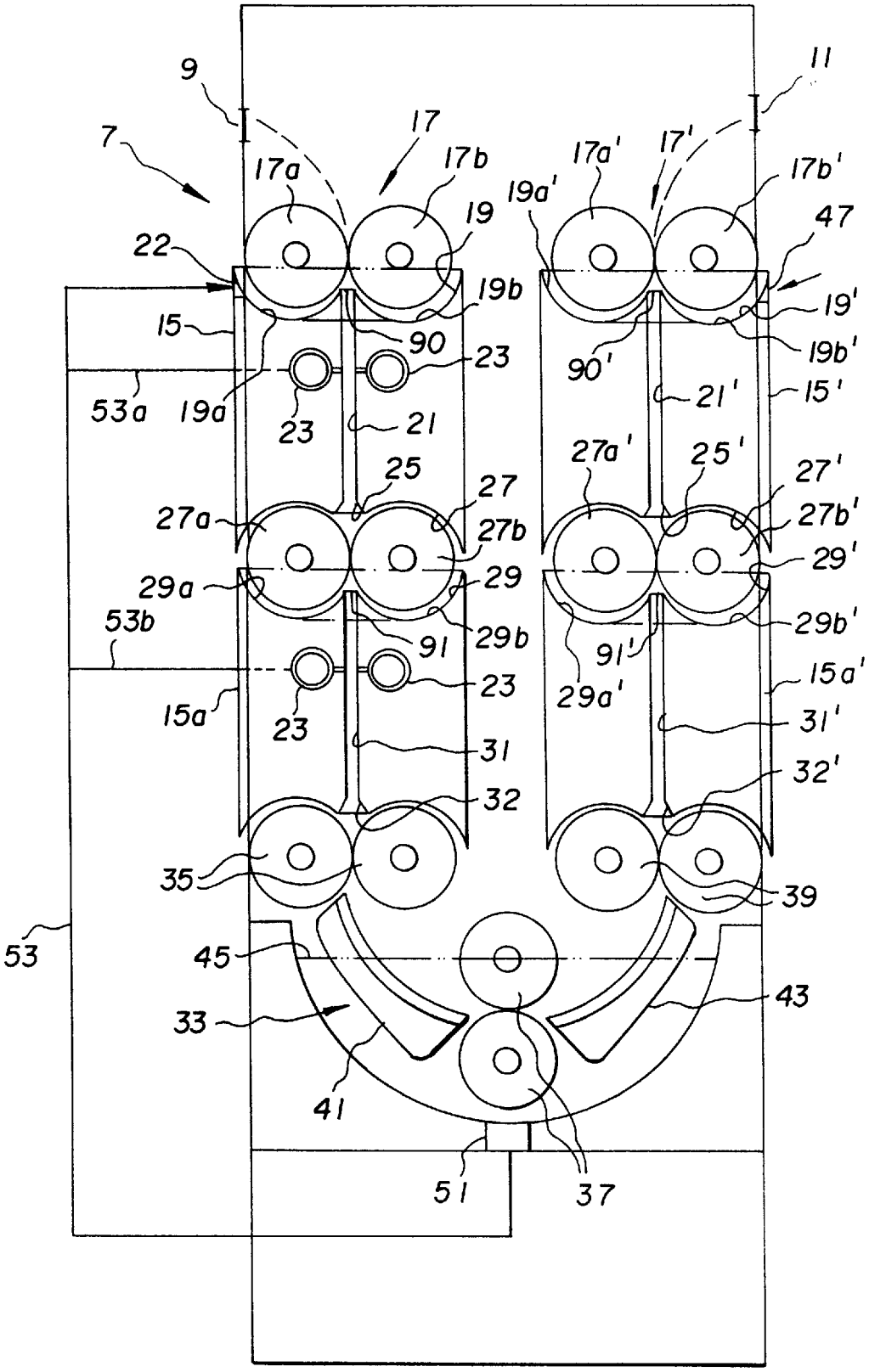
FIG. 1 shows an embodiment of a processing tank having the processing assembly of the present invention.

Referring now to the drawings, wherein like reference numerals designate identical or corresponding parts throughout the several views, FIG. 1 illustrates a processing tank 7 of a processor for processing photosensitive material. The processing of photosensitive material involves a series of steps which includes a series of tanks that contain developing solution, bleaching solution, fixing solution and washing solution. Processing tank 7 could be any of the above-noted tanks in the process and could include any of the above-noted solutions. Therefore, tank 7 as illustrated in FIG. 1 is applicable to but not limited to the washing step of a processing sequence. Tank 7 could also be a low-volume thin tank or rack and tank arrangement as illustrated in for example, U.S. Pat. No. 5,311, 235, the subject matter of which is herein incorporated by reference.

Tank 7 includes an inlet 9 for receiving photosensitive material to be processed and an outlet 11 through which the photosensitive material exits tank 7. Within the context of the present invention, processing and processing solution can respectively refer to any of the series of steps and solutions described above. As the photosensitive material enters tank 7, it is lead to a first processing assembly 15. First processing assembly 15 includes a conveying roller assembly 17 having rollers 17*a* and 17*b* between which the photosensitive material passes. Conveying roller assembly 17 is partially positioned in a tray assembly 19. Tray assembly 19 includes a first tray portion 19*a* positioned under roller 17*a* and a second tray portion 19*b* positioned under roller 17*b*. A guide path or slot 21 is in communication with and extends from first and second tray portions 19*a*, 19*b* to a further processing assembly 15*a* positioned below the first processing assembly 15.

Referring back to the first processing assembly 15, processing solution such as washing solution is applied at a port 22 so as to overfill the tray assembly 19. The processing solution that overflows tray assembly 19 is lead through opening 90 into guide path 21 and along guide path 21 to processing assembly 15*a* positioned below the first processing assembly 15. Thus, as photosensitive material passes between the nip portion of rollers 17*a,* 17*b,* the rollers 17,17*b* which are partially submerged in the overflowing solution apply the solution to the photosensitive material. The photosensitive material as well as the overflowing processing solution from tray assembly 19 are then lead into guide path 21 so as to process the photosensitive material as the photosensitive material and processing solution travel along guide path 21. Due to the provision of guide path 21 between tray portions 19*a,* 19*b* of tray assembly 19, the photosensitive material is washed while displacing and minimizing exposure to air.

Figure 2A:
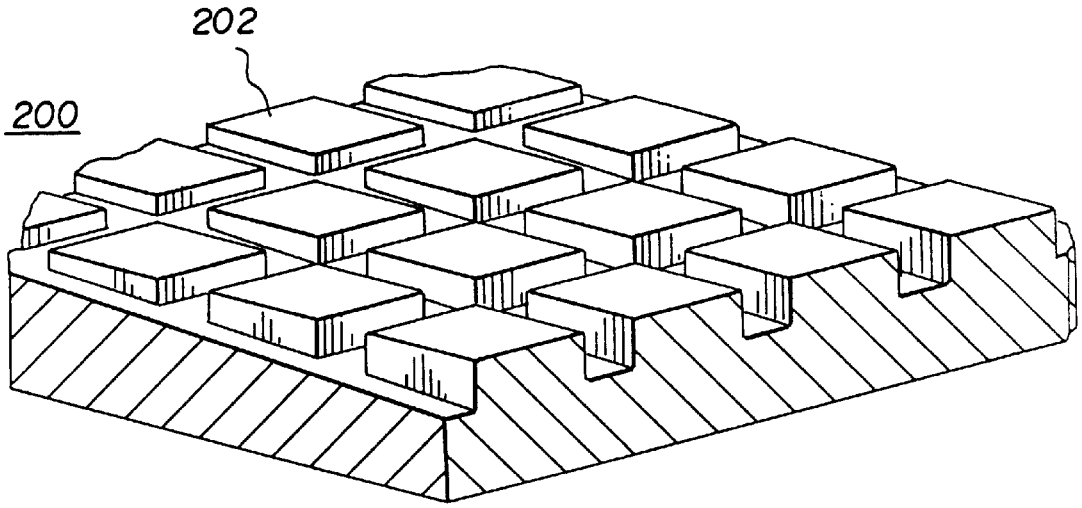
FIGS. 2A and 2B show textured surfaces which can be located on the processing path of the processing tank of the present invention.
Figure 2B:
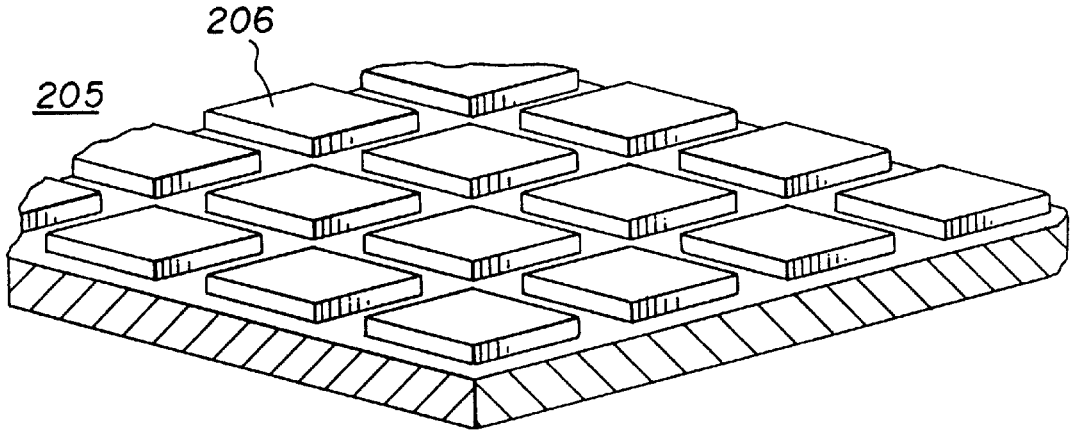

To further enhance the processing function of the processing solution, guide path 21 can include a textured surface which agitates the processing solution as it flow down guide path 21. FIGS. 2A and 2B are perspective drawings of textured fluid-bearing surfaces 200 and 205 which can be located on one or both surfaces of guide path 21. Textured surfaces 200 and 205 are textured by any known process, e.g., knurling, molded, EDM electro-discharged machined or applied. Knurls 202 or 206 are respectively shown on surfaces 200 and 205. The texturing (FIGS. 2A, 2B) and cantering (FIG. 2A) improve the flow of processing solution between the photosensitive material and the one or both surfaces of guide path 21, and prevent the photosensitive material from sticking on the surfaces.

As a further feature of the present invention, guide path 21 can include nozzles 23 which apply processing solution to the photosensitive material as it passes down guide path 21 to further enhanced processing such as cleaning.

As the photosensitive material and processing solution exit first processing assembly 15 at opening 25, the photosensitive material enters the nip portion of rollers 27*a,* 27*b* of conveying roller assembly 27 of the next processing assembly 15*a*. Also, the processing solution which exits first processing assembly 15 at exit 25 falls onto conveying roller assembly 27 of the next processing assembly 15*a* and fills up a tray assembly 29 of the next processing assembly 15*a*. This arrangement minimizes the exposure to air of the photosenstive material. As in processing assembly 15, tray assembly 29 includes a first tray portion 29*a* under roller 27*a* and a second tray portion 29*b* under roller 27*b*. The processing solution overflows the tray assembly 29 and is lead through opening 91 into a further guide path or slot 31. The photosensitive material which leaves first processing assembly 15 is conveyed by conveying roller assembly 27 into guide path 31 along with the overflowing washing solution. In the processing assembly 15*a,* the photosensitive material is further processed by the overflow of solution as it passes through guide path 31. Like guide path 21, guide path 31 can also include a textured surface as shown in FIGS. 2A and 2B and described with reference to processing assembly 15, as well as nozzles 23 to further enhance processing.

As the photosensitive material exits processing assembly 15*a* which along with processing assembly 15 define a downward portion of a processing path, it enters into a turnaround portion 33 which includes conveying rollers 35, 37, 39, as well as guiding surfaces 41 and 43. The processing solution which leaves guide path 31 at opening 32 falls onto conveying roller 35 between which the photosensitive material passes, and conveying rollers 35 apply processing solution to the photosensitive material and guide the photosensitive material onto guide surface 41. Processing solution which enters tank 7 can accumulate in the lower portion of tank 7 to a level as illustrated by line 45 so as to assure that the photosensitive material which leaves processing assembly 15*a* stays wet and has minimal exposure to air as it is transported along guide surface 41, conveying rollers 37 and guide surface 43.

The photosensitive material is thereafter transported by conveying rollers 39 into an upward path of the processing path which includes processing assemblies 15*a'* and 15'. Along the upward path, processing assemblies 15*a'* and 15' are similar to processing assemblies 15*a* and 15 but do not include nozzles 23. Accordingly, the same reference numerals used to describe processing assemblies 15 and 15*a* are used for processing assemblies 15' and 15*a'* except for the addition of a prime at the end of the reference numerals for processing assemblies 15' and 15*a'*.

Therefore, the photosensitive material is conveyed by rollers 39 through opening 32' to guide path 31' of processing assembly 15*a',* and upwardly conveyed along the path 31' through opening 91' until it reaches a nip portion of conveying roller assembly 27' which is partially submerged in processing solution contained in tray assembly 29'. Conveying roller assembly 27' includes rollers 27*a'* and 27*b'* respectively positioned over tray portions 29*a'* and 29*b'* of tray assembly 29'. Conveying roller assembly 27' conveys the photosensitive material upwardly through opening 25' into guide path 21' of processing assembly 15' which includes tray assembly 19' with conveying roller assembly 17' positioned therein. The photosensitive material exits guide path 21' through opening 90' and passes through the nip portion between rollers 17*a'* and 17*b'* of conveying roller assembly 17'. Conveying roller assembly 17' of processing assembly 15' thereafter conveys the photosensitive material to outlet 11 of processing tank 7.

Processing tank 7 of the present invention can include a port 47 which introduces fresh processing solution to processing assembly 15'. The fresh processing solution is applied to tray assembly 19' so as to overflow tray assembly 19' and lead the overflow processing solution through opening 90' to guide path 21'. The tray assembly 19' includes tray portions 19*a'* and 19*b'* respectively positioned under rollers 17*a'* and 17*b'*. The overflowing processing solution from tray assembly 19' is thereafter lead by guide path 21' and through opening 25' to conveying roller assembly 27' and tray assembly 29'. The overflow processing solution then enters guide path 31' of processing assembly 15*a'* through opening 91'.

Therefore, as the photosensitive material is lead through the upward portion of the processing path, and sequentially conveyed through processing assemblies 15*a'* and 15', fresh processing solution is applied at port 47 of processing assembly 15' and flows down toward processing assembly 15*a'*. At processing assembly 15*a'* the solution is lead through guide path 31' and out through opening 32' onto conveying rollers 39 to turnaround portion 33. This creates a counterflow of fresh processing solution to the photosensitive material as it is upwardly transported in the upward portion of the processing path.

One or both surfaces of each guide path 21' and 31' can also include textured surfaces as illustrated in FIGS. 2A and 2B and described with respect to guide paths 21 and 31 of processing assemblies 15 and 15*a*.

Processing tank 7 further includes a drain 51 at the bottom which is attached to a recirculation system 53. An example of a recirculation system is illustrated in for example, U.S. Pat. No. 5,309,191, the subject matter which is herein incorporated by reference. The processing solution collected at the bottom of tank 7 flows through recirculation system 53 into port 22 of first processing assembly 15. As a further feature of the present invention, the recirculated processing solution can optionally and selectively be directed via lines 53*a* and 53*b* to nozzles 23 of processing assemblies 15 and 15*a*. Therefore, with the arrangement of the present invention, as the photosensitive material is conveyed along the downward portion (processing assemblies 15,15*a*) of the processing path, it is continuously treated with recirculated processing solution. As the photosensitive material is conveyed along the upward portion (processing assemblies 15*a*',15') of the processing path, it is continuously treated with fresh processing solution which thereafter accumulates at the bottom of tank 7 and is recirculated via recirculation system 53 to thus be selectively applied to processing assemblies 15, 15*a*.

Figure 3:
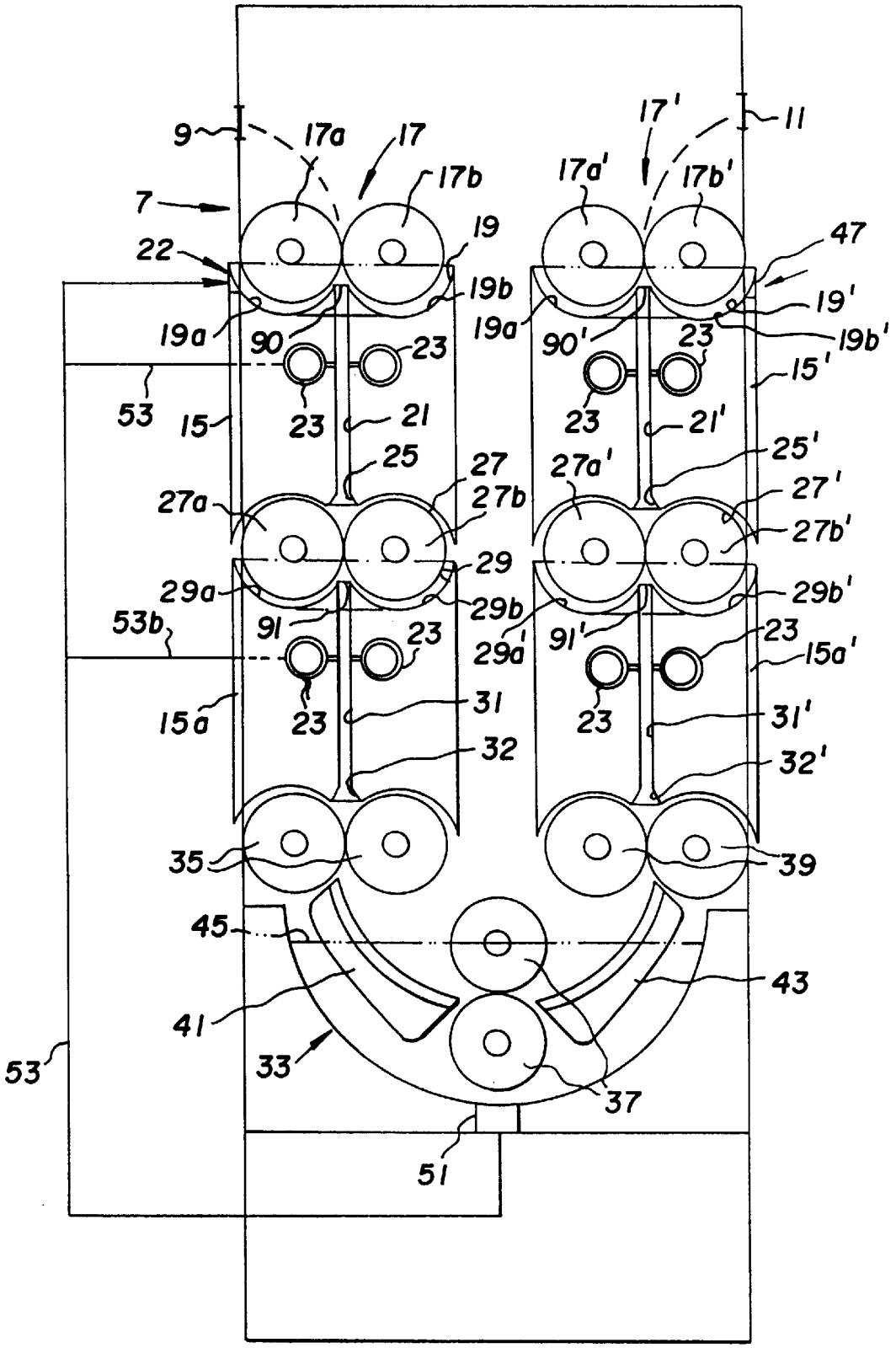
FIG. 3 shows an alternative arrangement of the processing tank of FIG. 1.

FIG. 3 is an alternative arrangement of the embodiment of FIG. 1 and therefore the same reference numerals for similar elements as used in FIG. 1 are used in FIG. 3. The embodiment of FIG. 3 differs from the embodiment of FIG. 1 in that all of the processing assemblies 15, 15*a*, 15*a*' and 15' include nozzles 23. The operation of the embodiment of FIG. 3, as well as the specifies of the elements of FIG. 3 are the same as the described operation and corresponding elements of FIG. 1.

Figure 4:
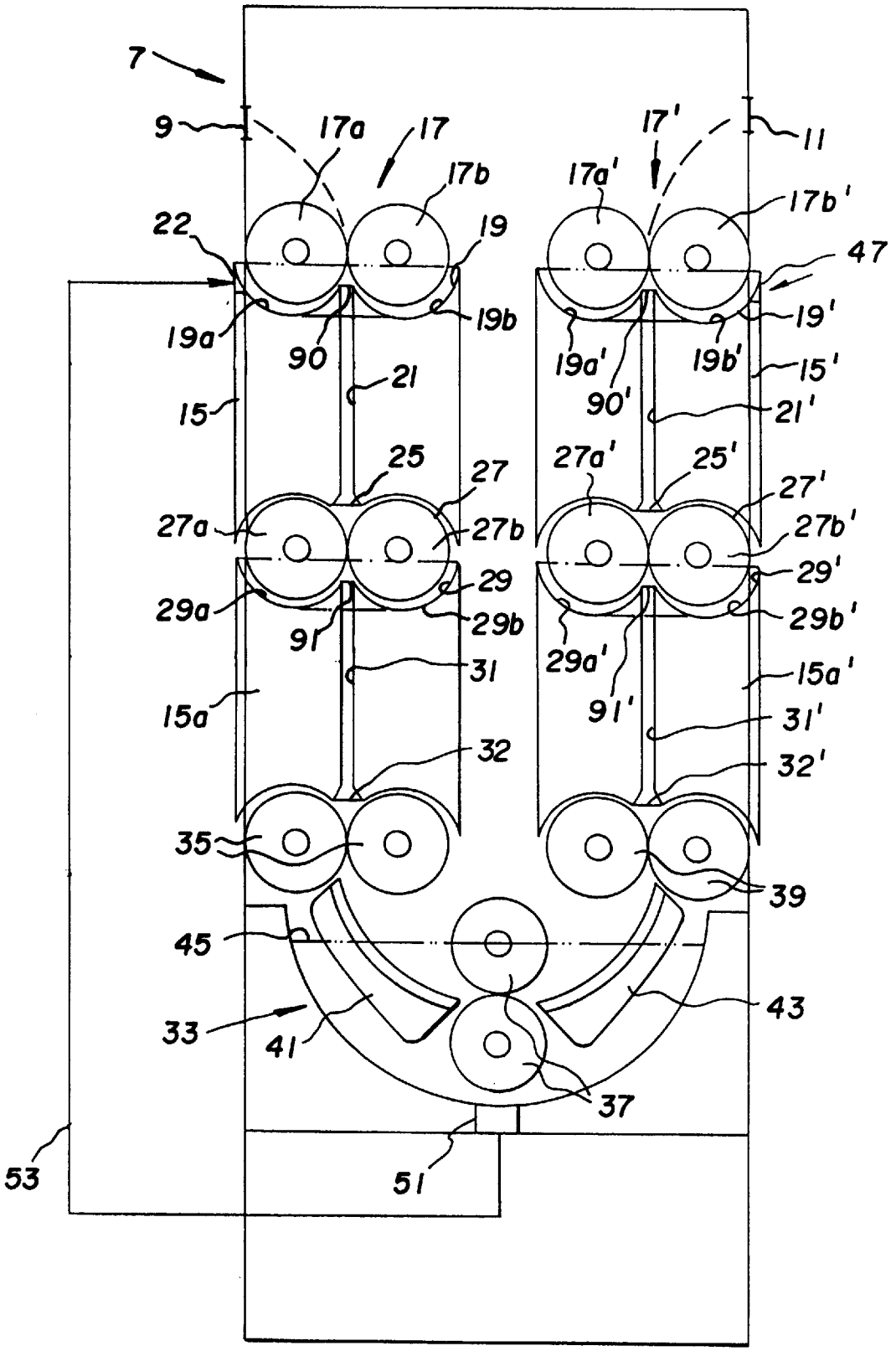
FIG. 4 shows an alternative arrangement of the processing tank of FIG. 1.

FIG. 4 is an alternative arrangement of the embodiment of FIG. 1 and therefore the same reference numerals for similar elements as used in FIG. 1 are used in FIG. 4. The embodiment of FIG. 4 differs from the embodiment of FIG. 1 as well as the embodiment of FIG. 3 in that none of the processing assemblies 15, 15*a*, 15*a*' and 15' include nozzles 23. The operation of the embodiment of FIG. 4, as well as the specifies of the elements of FIG. 4 are the same as the described operation and corresponding elements of FIG. 1. It is further noted that the guide paths 21, 31, 21' and 31' as shown in FIGS. 3 and 4 can also include textured surfaces as illustrated in FIGS. 2A and 2B.

Additionally, although the embodiments illustrated in the figures show two processing assemblies along the downward portion of the processing path and two processing assemblies along the upward portion of the processing path, it is recognized that the number of processing assemblies is based on design considerations, the size of the processing tank and the length of the processing path. As further noted in the drawings, each of the processing assemblies are arranged so as to define the processing path and also to minimize exposure of the photosensitive material being treated to air. Also, it is recognized that the application of fresh processing solution at the area of the exit of the photosensitive material from tank 7 is one example, and that fresh processing solution can be applied at the entry and exit of tank 7.

The invention has been described in detail with particular reference to certain preferred embodiments thereof, but it will be understood that variations and modifications can be effected within the spirit and scope of the invention.

What is claimed is:

1. An apparatus for processing photosensitive material, the apparatus comprising:

at least one processing tank having a processing path for the photosensitive material, said at least one processing tank comprising at least one first processing assembly along a downward portion of the processing path and at least one second processing assembly along an upward portion of the processing path;

wherein each of said first and second processing assemblies comprise:

a tray assembly which receives a processing solution therein;

a conveying roller assembly at least partially submerged in the processing solution contained in the tray assembly; and a guide path extending from said tray assembly, said guide path receiving an overflow of processing solution from said tray assembly and guiding the photosensitive material and overflow processing solution therethrough such that the processing solution flows in a direction parallel to the direction of travel of the photosensitive material in the downward portion of the processing path and in a direction opposite to the direction of travel of the photosensitive material in the upward portion of the processing path.

2. An apparatus according to claim 1, wherein said guide path comprises a textured surface which agitates said processing solution which overflows from said tray assembly and travels through said guide path, such that said agitated processing solution processes the photosensitive material in said guide path.

3. An apparatus according to claim 1, wherein said guide path comprises at least one nozzle which applies processing solution to the photosensitive material in the guide path.

4. An apparatus according to claim 1, wherein said processing solution is one of a washing solution, a developing solution, a bleaching solution and a fixing solution which is supplied to said tray assembly to create an overflow of processing solution, the overflow of processing solution being led from said tray assembly to said guide path so as to permit a processing of the photosensitive material in the guide path by the overflow processing solution.

5. An apparatus according to claim 1, wherein said conveying roller assembly comprises first and second opposing rollers between which the photosensitive material passes, and said tray assembly comprises a first tray portion positioned under the first roller and a second tray portion positioned under the second roller, said guide path downwardly extending from between the first and second tray portions.

6. An apparatus according to claim 1, wherein said at least one first processing assembly in the downward portion of the processing path is located at an entrance of the processing tank, the guide path of said at least one first processing assembly leading the photosensitive material and the overflow processing solution in the guide path to a nip portion of a conveying roller assembly of an adjacent downstream processing assembly.

7. An apparatus according to claim 1, wherein said at least one second processing assembly in the upward portion of the processing path is located at an exit of the processing tank, the guide path of the at least one second processing assembly receiving a photosensitive material from a nip portion of a conveying roller assembly of an adjacent upstream processing assembly, and the overflow processing solution is led by the guide path of the at least one second processing assembly to the nip portion of the conveying roller assembly of the adjacent upstream processing assembly.

8. An apparatus for processing photosensitive material, the apparatus comprising:

at least one processing tank including at least one processing assembly, said at least one processing assembly comprising a receiving portion for receiving processing solution therein and a guiding portion which guides a photosensitive material and overflow processing solution from the receiving portion therethrough.

9. A method of processing photosensitive material, the method comprising the steps of:

providing at least one processing assembly in a processing tank along the downward portion of the processing tank and at least one process assembly along the upper portion of the processing path, said at least one processing assembly comprising a tray assembly and a guide path extending from the tray assembly;

supplying a processing solution to the at least one processing assembly so as to overflow the tray assembly and be led into the guide path such that the processing solution in the downward portion travels substantially in the same direction as the photosensitive material and travels substantially in the opposite direction to the photosensitive material in the upward portion of the processing path; and conveying a photosensitive material through the guide path of the processing assembly, such that the overflowing processing solution treats the photosensitive material in the guide path.

10. A method according to claim 9, wherein said guide path of the at least one processing assembly extends to a further processing assembly so as to lead the photosensitive material to the further processing assembly.

11. An apparatus for processing photosensitive material, the apparatus comprising:

at least one processing tank having a processing path for the photosensitive material, said at least one processing tank comprising at least one first processing assembly along a downward portion of the processing path and at least one second processing assembly along an upward portion of the processing path;

wherein each of said first and second processing assemblies comprise:

a tray assembly which receives a processing solution therein;

a conveying roller assembly at least partially submerged in the processing solution contained in the tray assembly; and a guide path extending from said tray assembly, said guide path receiving an overflow of processing solution from said tray assembly and guiding the photosensitive material and overflow processing solution therethrough wherein said guide path comprises at least one nozzle which applies processing solution to the photosensitive material in the guide path.

12. An apparatus for processing photosensitive material, the apparatus comprising:

at least one processing tank having a processing path for the photosensitive material, said at least one processing tank comprising at least one first processing assembly along a downward portion of the processing path and at least one second processing assembly along an upward portion of the processing path;

wherein each of said first and second processing assemblies comprise:

a tray assembly which receives a processing solution therein;

a conveying roller assembly at least partially submerged in the processing solution contained in the tray assembly; and a guide path extending from said tray assembly, said guide path receiving an overflow of processing solution from said tray assembly and guiding the photosensitive material and overflow processing solution therethrough wherein said at least one first processing assembly in the downward portion of the processing path is located at an entrance of the processing tank, the guide path of said at least one first processing assembly leading the photosensitive material and the overflow processing solution in the guide path to a nip portion of a conveying roller assembly of an adjacent downstream processing assembly.

13. An apparatus for processing photosensitive material, the apparatus comprising:

at least one processing tank having a processing path for the photosensitive material, said at least one processing tank comprising at least one first processing assembly along a downward portion of the processing path and at least one second processing assembly along an upward portion of the processing path;

wherein each of said first and second processing assemblies comprise:

a tray assembly which receives a processing solution therein;

a conveying roller assembly at least partially submerged in the processing solution contained in the tray assembly; and a guide path extending from said tray assembly, said guide path receiving an overflow of processing solution from said tray assembly and guiding the photosensitive material and overflow processing solution therethrough wherein said at least one second processing assembly in the upward portion of the processing path is located at an exit of the processing tank, the guide path of the at least one second processing assembly receiving a photosensitive material from a nip portion of a conveying roller assembly of an adjacent upstream processing assembly, and the overflow processing solution is led by the guide path of the at least one second processing assembly to the nip portion of the conveying roller assembly of the adjacent upstream processing assembly.

14. An apparatus for processing photosensitive material, the apparatus comprising:

at least one processing tank having a processing path for the photosensitive material, said at least one processing tank having an upper portion and a lower portion, said at least one processing tank comprising at least one processing assembly along a downward portion of the processing path and at least one second processing assembly along the upward portion of the processing path, and a turn-around portion disposed in the lower portion of the tank below said first;

wherein each of said first and second processing assemblies comprise:

a tray assembly which receives a processing solution therein;

a conveying roller assembly at least partially submerged in the processing solution contained in the tray assembly; and a guide path extending from said tray assembly, said guide path receiving an overflow of processing solution from said tray assembly and guiding the photosensitive material and overflow processing solution therethrough, said processing solution being provided to said tray assembly at a rate such that processing solution accumulates only in the lower portion of the processing tank.

* * * * *